US006014845A

United States Patent [19]

Jain et al.

[11] Patent Number: 6,014,845

[45] Date of Patent: Jan. 18, 2000

[54] ENERGY-EFFICIENT SOLAR SHADE SYSTEM FOR SKYLIGHTS

[75] Inventors: Kanti Jain, Briarcliff Manor; Carl C. Kling, Armonk, both of N.Y.

[73] Assignee: Anvik Corporation, Hawthorne, N.Y.

[21] Appl. No.: 08/066,493

[22] Filed: May 24, 1993

[51] Int. Cl.[7] ..... E04B 7/18

[52] U.S. Cl. ..... 52/200; 379/591; 379/597

[58] Field of Search ..... 52/200, 202; 359/566, 359/591, 592, 596, 597

[56] References Cited

U.S. PATENT DOCUMENTS

| | | | |
|---|---|---|---|
| 3,482,107 | 12/1969 | Hock | 250/237 |
| 4,368,725 | 1/1983 | McClintock | 126/432 |
| 4,389,085 | 6/1983 | Mori | 350/96.1 |
| 4,411,493 | 10/1983 | Miller | 359/595 |
| 4,429,952 | 2/1984 | Dominguez | 350/258 |
| 4,522,467 | 6/1985 | Van Dame | 52/200 X |
| 4,600,627 | 7/1986 | Honda et al. | 428/20 |
| 4,710,426 | 12/1987 | Stephens | 428/336 |
| 4,733,505 | 3/1988 | Bartenbach | 359/596 |
| 4,765,724 | 8/1988 | Huichun | 350/162.18 |
| 4,928,666 | 5/1990 | Mori et al. | 52/200 X |
| 4,963,206 | 10/1990 | Shacklette et al. | 52/789 X |
| 5,009,484 | 4/1991 | Gerritsen | 350/162.11 |
| 5,027,566 | 7/1991 | Gilowski | 52/200 X |
| 5,048,925 | 9/1991 | Gerritsen et al. | 359/569 |

FOREIGN PATENT DOCUMENTS 4-175703 7/1992 Japan ..... G02B 6/00

*Primary Examiner*—Creighton Smith
*Attorney, Agent, or Firm*—Carl C. Kling

[57] ABSTRACT

An energy saving skylight cover system operates selectively in summer and winter to optimize transfer of the sun's radiation through the skylight into an interior space. The skylight cover system comprises optical transmission modifying panels and radiation scuppers that make its functional characteristics responsive to the sun's incidence angle. In summer mode, with high average inclination of the sun, the skylight cover system absorbs or reflects back the undesirable solar heat. In winter mode, the skylight cover system permits majority of the sun's rays to enter the interior space, permitting desirable solar heat gain. The determination of rejecting or accepting solar heat gain is made by the skylight cover system according to a designed-in characteristic angle. The characteristic angle is a function of the orientation of the skylight and the roof, and the geographical location of the building. For manufacturing cost-effectiveness, a finite set of skylight cover pane designs with predetermined characteristic angles is selected. The radiation modifying panels consist of one or more diffraction gratings, with additional spectrally selective and angle-selective coatings and materials for selective rejection and transmission of ultraviolet, infrared and visible portions of the solar radiation to provide maximum energy efficiency combined with optimum thermal and optical comfort of the building occupants.

18 Claims, 2 Drawing Sheets

ENERGY-EFFICIENT SOLAR SHADE SYSTEM FOR SKYLIGHTS

BACKGROUND OF THE INVENTION

1. Field of the Invention

This invention relates to solar shades for skylights, and more particularly relates to an energy-saving skylight cover system using one or more of diffraction gratings, angle-selective light transmitting and reflecting surfaces, and spectrally selective materials, to provide automatic control of the entry of selected radiation components of sunlight, notably ultraviolet, infrared and visible light, into an interior space.

2. Statement of the Problem

Many residential and commercial buildings have skylights to permit entry of daylight into their interiors. Most of these skylights are mounted on roofs that are not horizontal. Most of the skylights are also of a permanent nature, i. e., they are not openable. They are extremely useful devices, creating a window on the ceiling of the building and letting in much desirable daylight.

However, there are several aspects of skylights that are not desirable. Since most of the skylights consist of a clear glass pane mounted in a suitable frame, they permit entry of direct sunlight into the interior. Whereas during winter months such additional sunlight entering a room is desirable, in summer months the direct sunlight is more of a problem than an advantage. Direct sunlight in summer significantly increases heating of the interior space, making it more expensive to cool the room. Direct sunlight falling on furniture, upholstery, rugs, artwork and other contents of the room also causes their discoloration, fading, and faster overall deterioration. Direct sunlight may also be undesirable for various indoor plants and items such as books and art objects in shelves. Interior wall paint, particularly if other than white, is also known to fade and discolor more rapidly if exposed to direct sunlight. In summary, it would be highly desirable to be able to reduce the sunlight entering a room through a skylight in summer months without sacrificing the skylight's benefits including its aesthetic appearance.

3. Description of Related Art

A wide variety of window and skylight techniques are used for daylight entry, glare control, summer solar heat gain control, and winter heat loss control in residential and commercial buildings. These include:

a. fixed and adjustable mechanical methods such as shades, blinds, fins, awnings, slats and louvers;

b. conventional optical techniques such as use of colored low-transmittance glasses;

c. spectrally selective coatings of single metal layers and multilayer dielectric-metal-dielectric stacks; and d. chromogenic structures based on photochromic, thermochromic and electrochromic phenomena.

Most of these existing methods, however, are ineffective, inconvenient, or too expensive for use with skylights. One method that is sometimes used on skylights to cut down their sunlight transmission is venetian blinds. The disadvantages of venetian blinds on skylights are twofold:

a. venetian blinds mar the inherent aesthetic beauty that skylights provide to the interior of a room; and b. they block the sunlight after it has entered the room, thereby preventing only the light from entering the room, but not the heat.

Therefore, the need persists for new means and methods that can make skylights energy-efficient and radiation protective without diminishing their benefits of providing daylight and enhancing comfort and beauty of the interior space.

Energy-Efficient Skylights: General Considerations

An energy-efficient skylight should be capable of controlling the transfer of energy in both directions according to desired criteria. In the most basic terms, clearly, a good skylight should provide to the building occupants both optical and thermal comfort while minimizing expended energy. Overall, an optimized skylight should have the following characteristics:

a. It should admit adequate amount of daylight;

b. It should enhance architectural beauty of the building interior;

c. It should act as a thermal barrier for interior heat and provide for solar heat gain in winter;

d. It should minimize solar heat gain in summer; and e. It should provide spectral control to enable selection and rejection of different sunlight components as desired.

Available Methods for Improving Window Efficiency and Their Applicability to Skylights A wide variety of techniques have been developed and employed for controlling energy transfer through windows. These include various mechanical, thermal and optical methods. The most common of these are movable interior sun control devices such as shades, drapes, blinds, etc. However, the above techniques are only marginally able to contribute in improving the energy efficiency of skylights because the skylights are not in a vertical plane and face the sun more directly. Fixed exterior sun control systems for windows, such as awnings and overhangs, are totally inapplicable to skylights.

Traditional Optical Methods

Many different optical techniques have been developed for window efficiency improvement. Some of these techniques are more readily applicable to skylights than others. Low-transmittance glass is widely used in windows and sometimes also in skylights. The glass is highly colored and is made light-absorbing by various additives. This helps in reducing the cooling load in summer months, but simultaneously, it also limits the available daylight substantially and reduces the beneficial solar heat gain in winter months.

Since the visible and infrared components of solar radiation are partially separable, it is possible to coat the windowpanes so that they transmit the solar luminous radiation ($\lambda \sim 0.4$–$0.7\ \mu m$) while blocking the solar infrared spectrum ($\lambda \sim 0.7$–$3.0\ \mu m$). Since the distribution of solar radiation among the above two spectral regions is nearly equal, in principle it is possible to prevent approximately half of the solar energy from entering the interior without impacting the daylight transmittance of the window. Such spectrally selective coatings are typically thin layers of a free-electron metal, such as Cu, Ag or Au. The luminous transmittance can be boosted by sandwiching the metal layer between two layers of high-refractive-index dielectric materials. Commercially, such coatings are now applied widely to vast numbers of windows and to some extent, to skylights.

Diffraction Grating

A diffraction grating is an arrangement which imposes on incident light a periodic variation of amplitude or phase, or both. A typical diffraction grating is a plastic sheet with a number of equidistant parallel depressions which cause characteristic spectral dispersion of transmitted light.

Diffraction gratings are well known, and are available from a number of sources including the following:

| Acton Research Corp. | Milton Roy Co. | Optometrics USA Inc. |
|---|---|---|
| Acton MA | Rochester NY | Ayer MA |

Typical discussions of diffraction gratings appear in the following textbooks:

Halliday & Resnick, PHYSICS, Wiley & Sons, N.Y., 1966, pages 1123–1124.

Hecht & Resnick, OPTICS, Addison-Wesley, 1974, pages 354–358.

Born & Wolf, PRINCIPLES OF OPTICS, Pergamon Press, 1986, pages 401–404.

The angle-selective radiation controlling windowpane (16) may be a multilayer dielectric coating on a suitable substrate. Substrates generally are temporary or permanent support layers for other layers, which typically cannot support themselves.

The sun's incidence angle is the angle between sun and horizon.

The skylight characteristic angle is the angle designed into a particular skylight, related to its orientation on a roof, including the angle of the roof and the geographical location of the building, together with its built-in optimizations of rejection or acceptance of solar heat gain.

A radiation scupper is a device which accepts solar radiation and redirects it for discharge or reuse.

Note that whereas spectrally coated windows can exhibit significantly more summertime energy efficiency than uncoated glass, they will still fall short of the best achievable performance because they fail to adapt to seasonal changes and different climatic conditions. In cold climates it is also important to provide a good thermal barrier to prevent loss of interior heat through the windows. This can be done by using evacuated dual-pane glazings, and by using dielectric-metal-dielectric glazings optimized to provide high reflectivity at longer wavelengths (3–50 $\mu$m spectral region). Window coatings for good thermal insulation and good solar luminous transmittance have also been made by applying thin layers of certain heavily doped oxide semiconductors, such as $SnO_2$:F, $In_2O_3$:Sn and ZnO:A2. It should be noted that as additional coatings become necessary to achieve transmittance control of different solar spectral regions, the window cost increases significantly. For these reasons, such complex coatings are not yet commonly found in windows, and much less in skylights.

Chromogenic Coatings

The most desirable function in an ideal window or skylight is dynamic control of heat gain, heat loss, and luminous transmittance as a function of varying conditions during the day or with the seasons. Many types of such 'smart' coatings have been developed for windows and fall under the broad category of chromogenic coatings. These include photochromic, thermochromic and electrochromic coatings. Photochromic coatings undergo change in their transmittance properties as the intensity of the radiation incident on them changes. Photochromic sunglasses are a well known example of such a coating. The optical properties of thermochromic coatings are determined by temperature changes. Electrochromic layers use the phenomenon of electrically-activated injection or extraction of mobile ions into or from a certain region. It is well known in oxides of various transition metals such as W, V, Mo, Ni, Ti, Ir, etc. and many organic materials, and enables one to vary radiation transmittance over a wide range, e. g., 20–70%. However, for large-scale application to windows and skylights, economical chromogenic coatings with satisfactory performance (i. e., a full dynamic range of optical and thermal control) are not yet available.

The substrate may be the energy reflecting windowpane (16) diffraction grating.

The preferred diffraction grating is selective for accepting low azimuth angle sunlight and rejecting high azimuth angle sunlight. Where the energy reflecting windowpane (16) comprises a plurality of layers, in optical series, at least one of the layers should be a diffraction grating and at least one of the layers may be a chromogenic coating.

Energ-Efficient Windows with Diffraction Gratings and Scuppers

In a copending patent application, one of the coinventors of this invention, Dr. Kanti Jain, describes an energy-efficient window system with multiple fixed and movable diffraction grating windowpanes. These fixed and movable panes are either positioned to admit sunlight into the interior space of a room, or alternatively positioned to direct certain sunlight components to a set of scuppers which can absorb heat for use or disposal, or are aligned to reflect heat back out of the interior space. See United States patent application of Kanti Jain, Ser. No. 08/047,238, filed Apr. 13, 1993, ENERGY EFFICIENT WINDOW.

PATENTED PRIOR ART

United States Patents describing energy efficiency techniques for skylights include the following:

U.S. Pat. No. 5,062,247, Dittmer, VENTILATED MULTIPLE PANE SKYLIGHT, Nov. 5, 1991. Dittmer shows a skylight which is ventilated by airflow from soffet vents in an overhang.

U.S. Pat. No. 5,179,992 Okarski and Okarski-Lawlor, SELF CONTAINED REMOVABLE SUNSHADE FOR THE EXTERIOR OF CURB-MOUNTED SKYLIGHTS, Jan. 19, 1993. Okarski and Okarski-Lawlor position a shading screen of wire mesh over an existing domed or flat curb skylight and hold it in place with a bungee cord drawstring through grommets.

Additional patents, which primarily concern improvements to the mounting of skylights to make them waterproof, include the following:

Re. 32,915, Jentoft and Couture, SKYLIGHT CONSTRUCTION, May 2, 1989;

Re. 33,720, Cummings, SKYLIGHT ASSEMBLY, Oct. 22, 1991;

Re. 32,539, Jentoft and Couture, SKYLIGHT CONSTRUCTION, Nov. 10, 1987;

U.S. Pat. No. 5,148,643, Sampson and Flanigan, SKYLIGHT CONSTRUCTION, Sep. 22, 1992.

Limitations of Current Skylight Technologies

Limitations of the existing skylight technologies include:

(a) Fixed exterior sun control devices such as awnings and overhangs are inherently incompatible with skylights because of the latter's conventionally non-vertical orientation and the concomitant installation difficulties.

(b) Movable exterior systems, e. g., fins, slats and louvers are similarly inappropriate for skylights due to installation difficulties. They are high in installation and service costs, and also have the disadvantage of being susceptible to damage from adverse weather conditions such as snow, rain, frost, and high winds.

(c) Movable interior mechanical systems such as shades, blinds and drapes are also inconvenient to install on skylights, and when used, mar the inherent architectural beauty added by the skylight to the interior. In addition, they do not offer selectivity between the visible and infrared portions of the solar spectrum.

(d) Low-transmittance glass skylights, while reducing the cooling loads in the summer months, also permanently limit the available daylight. In winter months, when the solar heat gain is desirable, the low-transmittance feature cannot be deactivated.

(e) Spectrally selective coatings designed for high transmittance in the visible portion of the solar spectrum and high reflectance in the infrared portion make a skylight efficient in summer months, but do not provide effective utilization of the solar heat gain in winter.

(f) Chromogenic (photochromic, thermochromic, and electrochromic) coatings provide dynamic, but limited and non-user-modifiable, control of solar heat gain and luminous transmittance. Further, for large-scale application to skylights, economical chromogenic coatings with satisfactory performance are not yet available.

(g) Energy-efficient window systems employing fixed and movable diffraction grating panes according to the earlier invention of coinventor Dr. Kanti Jain, referenced above, are effective but relatively expensive and complex for use as skylights.

From the above list, it is clear that the existing techniques for improving energy efficiency of skylights suffer from major limitations. Therefore, the need exists for a skylight or a skylight cover system that provides automatic, dynamic control of solar heat gain and luminous transmittance during the day and with the seasons, is convenient to install, and is cost-effective.

SUMMARY OF THE INVENTION

It is the object of the invention to provide an energy-efficient skylight cover system which effectively addresses the shortcomings of existing skylights, permitting automatic, dynamic control of solar heat gain through the skylight during the day and in both summer and winter months, while providing good luminous daylight transmittance.

Another object of the invention is to provide a skylight cover system that enables effective control of solar heat gain and luminous transmittance, does not diminish the inherent aesthetic beauty of the skylight, and inhibits damage to furniture, upholstery, artwork, rugs, paint, etc.

A feature of the invention is that the dynamic control of the skylight solar transmittance is automatic, i. e., responsive to the sun's angle of incidence which varies from summer to winter and during the day.

Another feature of the invention is a set of economically produced radiation modifying diffraction grating panels, which are designed to accept low-angle winter sun for desired heat gain and daylight, and to substantially reject high-angle summer sun to limit excessive heat gain.

An advantage of the invention is that it provides a skylight cover system which combines the energy-efficiency features of solar transmittance control with the comfort of providing daylight in the interior and the aesthetic beauty of skylights.

Another advantage of the invention is that the energy-efficient skylight cover system redirects selected components of entering solar radiation to a set of scuppers for disposal or use.

Another advantage of the invention is that the energy-efficient skylight cover system is optimizable for different solar inclinations, building structures and building orientations.

Other objects, features and advantages of the invention will be apparent from the following written description, claims, abstract and the annexed drawings.

The energy saving skylight cover system operates selectively in summer and winter to optimize transfer of the sun's radiation through the skylight into an interior space. The skylight cover system comprises optical transmission modifying panels and radiation scuppers that make its functional characteristics responsive to the sun's incidence angle. In summer mode, with high average inclination of the sun, the skylight cover system absorbs or reflects back the undesirable solar heat. In winter mode, the skylight cover system permits the majority of the sun's rays to enter the interior space, permitting desirable solar heat gain. The determination of rejecting or accepting solar heat gain is made by the skylight cover system according to a designed-in characteristic angle. The characteristic angle is a function of the orientation of the skylight and the roof, and the geographical location of the building. For manufacturing cost-effectiveness, a finite set of skylight cover pane designs with predetermined characteristic angles is selected. The radiation modifying panels consist of one or more diffraction gratings, with additional spectrally selective and angle-selective coatings and materials for selective rejection and transmission of ultraviolet, infrared and visible portions of the solar radiation to provide maximum energy efficiency combined with optimum thermal and optical comfort of the building occupants.

DESCRIPTION OF THE PREFERRED EMBODIMENTS

Figure 1:
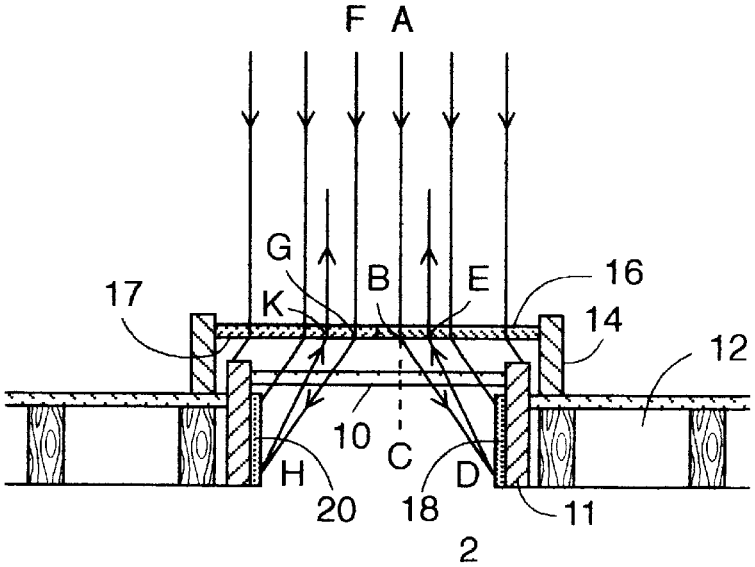
FIG. 1 is a schematic diagram of a skylight cover system comprising a diffraction grating and radiation reflecting scuppers according to the invention, shown as a cross-sectional view of the skylight cover system installed on a skylight.

FIG. 1 illustrates a preferred embodiment of the invention. It shows in cross section and in horizontal orientation a skylight which comprises a skylightpane 10 extending on a frame 11 which is set into the roof structure 12 so that the skylightpane 10 is in a plane parallel to and slightly higher than the plane of the roof 12. Such a device can be a traditional skylight (in which the skylightpane 10 is a common glass pane) to which the skylight cover system of this invention is retrofitted, or it can be a new skylight system which incorporates in its construction the skylight cover system of this invention, as described below.

The skylight cover system of this invention is mounted on top of such a new or existing conventional skylight. The skylight cover system comprises a frame 14 which houses one or more radiation modifying skylight cover panes 16 which, when mounted, are parallel to the skylightpane 10 of the existing skylight. Each of the skylight cover panes 16 comprises radiation modifying means such as a diffraction grating, spectrally selective coating, angle-selective coating, or a composite of these as will be described below. The skylight cover system also includes scuppers 18 and 20 which are mounted on the inside of the skylightpane 10 (i. e., within the interior space) and are designed to work functionally with the cover panes 16. According to one embodiment of the invention, a typical radiation modifying skylight cover pane 16 is made of clear plastic, with its inner surface 17 so prepared that it acts a a set of two diffraction gratings, right and left, with certain predetermined deflection characteristics.

Operation

Let us first describe the operation of the skylight cover system in summer months when it is desirable to prevent entry of excessive sunlight into the interior space. Consider incident sun rays AB and FG. The diffraction grating 17 in the right half of the radiation modifying skylight cover pane 16 is so designed that it diffracts light ray AB substantially into its first diffraction order BD. BC shows the continuous path ray AB would have taken without the diffraction grating 17. On the inside of the skylight, within the interior space 2 of a room, scuppers 18 and 20 are affixed to the skylight frame 11, generally outside the direct paths of optical rays passing through the skylightpane 10. Scuppers 18 and 20 can take various forms, being generally either radiation absorbing or radiation reflecting. The diffraction of incident ray AB by the right half of the radiation modifying skylight cover pane 16 is such that the first diffraction order BD is directed to scupper 18. Scupper 18 is a reflecting scupper, and can be fabricated as a diffraction grating. Ray BD, after reflection by scupper 18 as ray DE, is sent back out through skylightpane 10 and skylight cover pane 16. Note that without the diffraction grating 17, incident ray AB would have entered the room undeflected as ray BC. The unwanted solar heat gain thus is thwarted by redirecting the sun's rays back to the outside of the interior space 2.

In a similar fashion, the left half of diffraction grating 17 is such that an incident ray FG is substantially diffracted into its negative first order as ray GH. Ray GH strikes scupper 20, which also has a diffracting surface which is so designed that ray GH is effectively reflected as ray HK.

Thus the unwanted heat from ray GH is transferred back outside the interior space 2 of the room.

Thus, the combination of the diffraction grating 17 of radiation modifying skylight cover pane 16 and the reflecting scuppers 18 and 20 prevents bulk of the solar radiation from entering the interior space 2. By suitably choosing the grating design parameters and by adding spectrally selective materials, the rejection of the sunlight can be tailored to be more pronounced in its infrared (IR) and ultraviolet (UV) portions and less in the visible portion, thereby removing the harmful IR and UV components of solar radiation while partially permitting the desirable daylight Some visible light will also enter the room due to diffraction of the incident ray into the 0 orders, shown for ray AB as ray BC. Thus, there will be adequate direct view of the exterior for a person looking out through the skylight, whereas the majority of the solar heat gain will be eliminated.

Let us now describe the application of the embodiment in winter months. The diffraction grating 17 may be so designed that in winter months, when the sun's rays are incident at very low inclination angles, their deflection is such that the rays miss the scuppers 18 and 20, and enter the room directly, thereby providing the desired solar heat gain. Additionally, the scuppers may be repositioned or removed to prevent back reflection of the diffracted rays to the outside. It is also functionally practical, even preferable, to simplify the design of the grating by optimizing it for summer operation only, and in winter months, to simply remove the solar shade, thereby permitting the maximum solar heat gain possible.

The design of the diffraction gratings depends upon the orientation of the solar shade (and thus, the orientation of the roof) and its location of installation with respect to the sun. The deflection angles of the diffraction grating will change during the day with changes in the azimuth angle and the direction orientation of the sun. Therefore, the grating is so designed that it optimizes the desired deflection followed by the blocking with scuppers 18, 20 during the hottest part of the summer day, i. e., the high azimuth angle periods of the year as measured at the skylight roof angle and directional orientation.

For efficient operation of the solar shade, therefore, careful design of the diffracting surface 17 of the skylight cover pane 16 is necessary in order to optimize it for different orientations and building locations. In practice, optimized diffraction grating parameters for different skylight locations, roof angles, directional orientations and longitudes of installation locations can be readily produced by computerized design processes. Such optimization can either be performed for each skylight on a custom basis, or, from low-cost manufacturing considerations, a small set of semi-customized solar shade designs can be generated that will operate at near-optimum overall efficiency for a large majority of applications.

Figure 2:
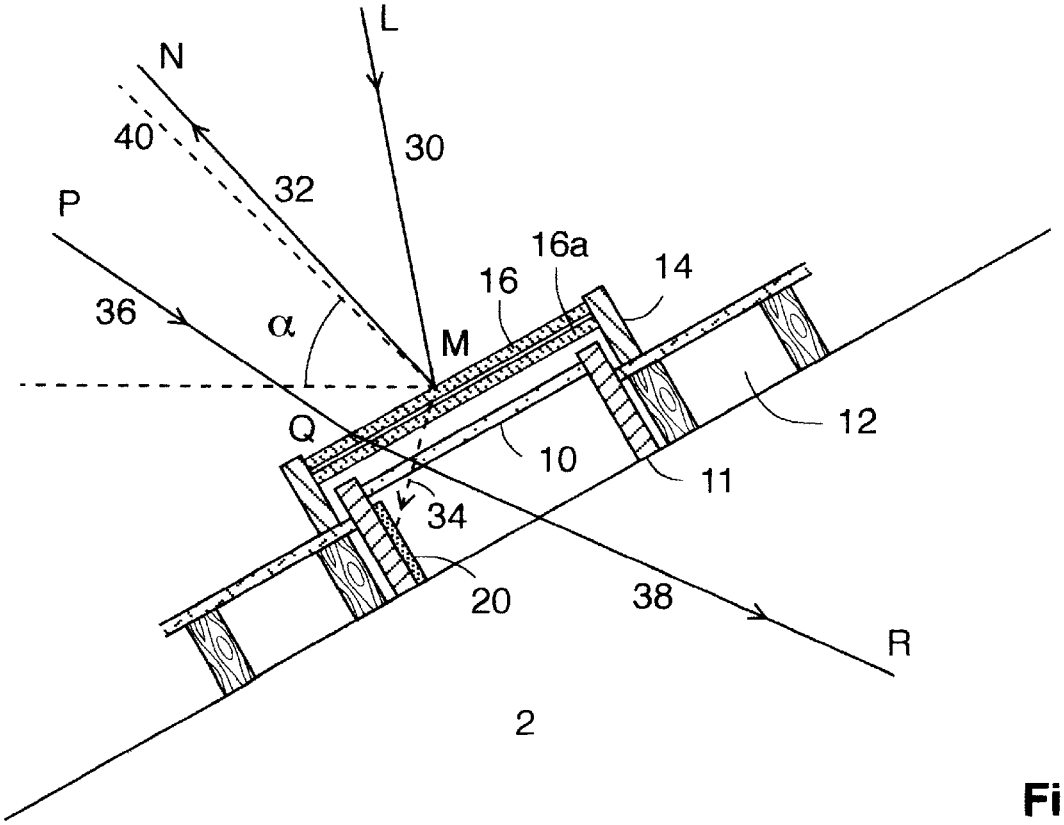
FIG. 2 shows a skylight cover system with a composite reflecting and transmitting diffraction grating operating in a summer mode and in a winter mode.

A second embodiment of the invention is illustrated in FIG. 2. It shows a conventional skylight with its pane 10 and frame 11 mounted in roof 12 as before in FIG. 1. The energy-efficient skylight cover system according to the invention consists of a frame 14 which houses one or more radiation modifying diffraction grating cover panes 16 and 16*a*. The diffraction grating panes are so designed that in summer months, the sun's undesirable rays are reflected, whereas in winter months, when solar heat gain is desirable, the rays are transmitted into the interior. The criteria for such a design are described with reference to FIG. 2 as follows. Let us define a characteristic angle $\alpha$ as the angle between the horizontal and a certain characteristic direction 40. The direction 40 is so determined that during summer months, the most intense rays of the sun (during mid-day) are at inclination angles greater than $\alpha$ and are considered undesirable as providing unwanted heat gain, while in winter months, the majority of the sun's radiation is incident at inclination angles less than $\alpha$, and is considered desirable as providing much wanted heat gain. The diffraction grating panels (16, 16*a*) of the skylight cover system are so designed that for a ray LM (30) incident at an inclination angle $>\alpha$, they act as a reflection grating, sending the ray back as ray MN (32), whereas for a ray PQ (36) incident at an inclination angle $<\alpha$, they act as a transmitting panel, letting the ray into the interior space 2 as ray QR (38). Thus, excessive heat from the high-angle summer sun is rejected, while the desirable low-angle winter sunlight is accepted.

A variation in the above embodiment includes a scupper 20, which is so designed that if some of the sunlight represented by ray 30 is transmitted (due to less than total reflection by the grating panels 16 and 16*a*) as ray 34, scupper 20 either absorbs it or reflects it back to the outside. This improves the energy efficiency of the skylight cover system. In the case where ray 34 is absorbed by scupper 20, the extracted heat may be either disposed of or utilized. The grating panels (16, 16*a*) can either be a single panel or a stack of multiple gratings to produce the desired deflection.

Diffraction Grating Fabrication Techniques

The radiation modifying diffraction grating skylight cover panes described above can be fabricated very economically in high volumes. Since the performance requirements on such gratings primarily amount to deflection by a certain angle +/− a few (~2–5) degrees, the fabrication tolerances are very lenient. They can therefore be conveniently and economically produced by mass production techniques. A complete diffraction grating skylightpane may be made as a laminate consisting of a plane glass or acrylic pane and a thin diffraction grating sheet stamped on a suitable plastic material (such as acrylic). The diffraction grating sheet may be affixed to the glass or acrylic pane using a suitable adhesive. In addition to acrylic, other material options for the grating sheet include cellulose triacetate, cellulose acetate butyrate and polyester or polyethylene teraphthalate (PET). The diffraction grating may also be stamped or otherwise produced directly on the substrate pane itself during production or as a subsequent treatment.

Such materials, even though possibly dielectric, when used to form a diffraction grating in the context of this invention, do not serve the optical functions served by multiple dielectric coatings or chromogenic coatings.

For the high-volume stamping process, first a master grating is made on a hard substrate, e. g., a metal plate, by conventional grating ruling techniques. The grating ruling parameters are determined to maximize the diffraction intensity into the +1 or −1 order, as desired. The master grating can now be used to stamp large numbers of gratings on sheets of various plastic materials described above. Another well known mass replication technique is injection molding. We remark that these processes are essentially very similar to high-volume manufacturing processes used in the fabrication of a variety of products that consist of surface relief patterns such as zone plates, Fresnel lenses and optical data storage disks including music compact disks (CDs). To illustrate the economical nature of such manufacturing processes, it is useful to note, for example, that although the retail price of a music CD is ~$15, its production cost is no more than ~50–70 cents.

Holographic Techniques

An alternative to the diffraction grating approach is to achieve the desired deflections holographically. Here we produce a suitable surface relief pattern in the plastic material to create a transmissive or reflective hologram, which reflects or deflects the light in a similar fashion as a conventional diffraction grating.

The operation of the skylight cover system as illustrated in FIG. 1 has used sun rays at 'normal' incidence. In practice, the gratings can be optimally designed for any desired angle of incidence by appropriate choice of the groove angle and pitch of the gratings. In a more advanced configuration, such as a movable circular skylight in a flat roof, the entire skylight assembly can be made capable of rotating in an appropriate housing so that it can be adjusted for different angles of incidence during a substantial part of the daylight hours. As a further improvement, such adjustment can be automatically effected by suitable sensors, a feedback system and motorized mechanisms.

In another variation of the embodiments of FIGS. 1 and 2, the diffraction grating skylightpane may be so designed that its deflection characteristics vary across one of its dimensions, still directing most of the diffracted rays to a scupper, but now enabling reduction in the size of the scupper and other structural design improvements. Such varying deflection characteristics may be produced by fabricating the diffraction grating with varying groove pitch and/or groove angle.

Spectral control

Figure 3:
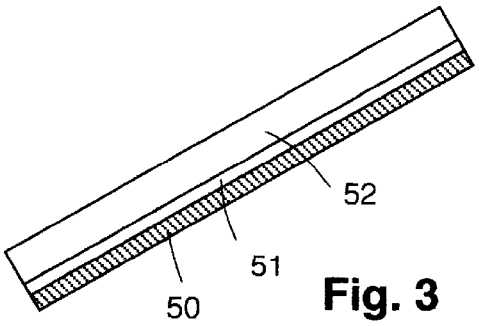
FIG. 3 is a schematic diagram of the radiation modifying cover pane of a skylight cover system, comprising a diffraction grating and a spectrally selective layer deposited on an optical substrate.

Spectral control can be designed into the disclosed skylight cover system concept as desired. For example, the diffraction gratings can be so designed that the operations described in FIGS. 1 and 2 are optimized to reject wavelengths near 1 $\mu$m, which will thus reduce solar heat gain while still permitting diffuse visible light to enter the room. Additional spectrally selective glazings for control of optical and thermal reflectance and transmittance in the spectral regions of 0.40–0.7 $\mu$m, 0.7–3.0 $\mu$m and 3–50 $\mu$m, can be incorporated in the skylight cover system along with its diffraction gratings. FIG. 3 illustrates in cross section a radiation modifying skylightpane for the skylight cover system according to the invention that combines a diffraction grating member 50 with a spectrally selective optical coating 51 on a glass or acrylic substrate 52.

Figure 4:
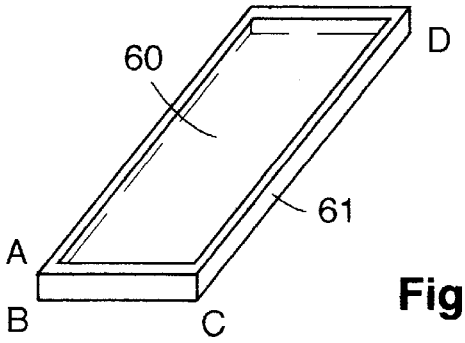
FIG. 4 is a perspective view of an alternate embodiment of the invention, showing an energy-efficient skylight cover system comprising a spectrally selective radiation modifying skylight cover pane mounted in a frame.

In another embodiment of the invention, the radiation modifying diffraction grating panel of the skylight cover system may be replaced by a spectrally selective radiation attenuating panel. Specifically, the panel may be constructed of such an optical material that it almost completely blocks the ultraviolet portion of the solar spectrum, reduces significantly the infrared portion, and provides moderate attenuation in the visible spectrum. A suitably doped (tinted) and glazed sheet of glass or acrylic can be produced to meet these requirements. Further, by using a multilayer dielectric or dielectric-metal-dielecteric glazing, the optical transmission of the panel can also be made angle-selective to some extent. FIG. 4 illustrates this embodiment, showing the radiation modifying panel 60 mounted in a frame 61. The length CD, width BC and height AB of the full skylight cover assembly are so designed that they provide adequate clearance (e. g., 1–2 inches) between it and the skylight on which it is installed. We have reduced this embodiment to practice by constructing two energy-efficient skylight cover systems according to the invention.

Figure 5:
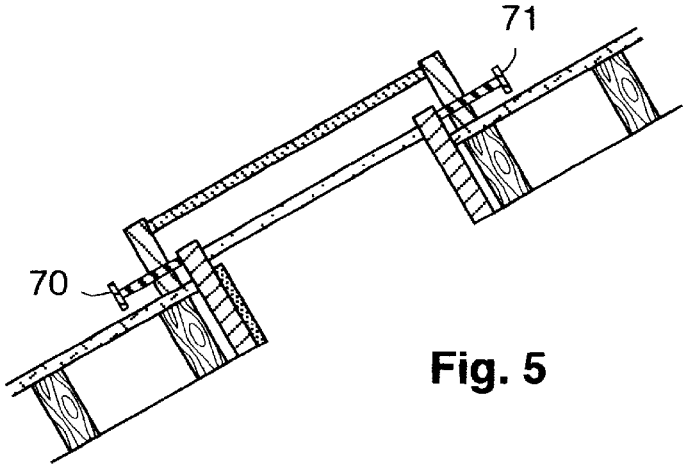
FIG. 5 is a schematic illustration showing in cross section the details of the securing means for installing a skylight cover system on a skylight.
Figure 6:
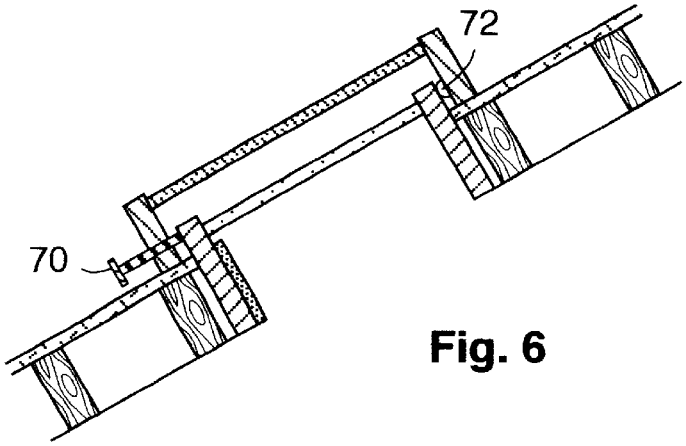
FIG. 6 is a schematic illustration showing in cross section alternate securing means for installing a skylight cover system on a skylight according to the invention.

The installation of the skylight cover system on an existing skylight may involve simply placing it on the roof so as to cover the skylight, where it stays in position by its weight and friction of the roof. For more secure installation, the skylight cover system may include one or more clamping means, as shown by 70 and 71 in FIG. 5. Alternatively, as shown in FIG. 6, one may use clamping means 70 on one side and rubber bumpers 72 on the other side.

The invention has been shown preferably in the form of a energy-efficient skylight cover system having diffraction grating and other radiation modifying means arrayed to reject high-angle sun rays in summer mode and to accept low-angle sun rays in winter mode, using or bypassing a set of scuppers, with spectral coatings for further selectivity of visible, ultraviolet and infrared radiation passing into an interior space. It will be clear to those skilled in the art that the above embodiments and other modifications, whether described as alternatives or not, will be usable without departing from the spirit and scope of the invention, as described in the following claims.

What we claim is:

1. An energy saving skylight cover system, for controlling solar radiation at an incidence angle, defined as the angle between sun and horizon, entering an interior space through a skylight, comprising:

a) a frame (14) positionable over such skylight; and b) an angle-selective radiation controlling windowpane (16), having at least one multiple-dielectric coating which redirects solar radiation impinging on such skylight at an incidence angle greater than a characteristic angle, the angle designed into such skylight, related to its orientation on a roof, including the angle of the roof and the geographical location of the building together with its built-in optimizations of rejection or acceptance of solar heat gain, and which admits radiation impinging on such skylight at an incidence angle less than said characteristic angle.

2. An energy saving skylight cover system according to claim 1, wherein said angle-selective radiation controlling windowpane (16) is optimized spectrally for rejection of ultraviolet radiation.

3. An energy saving skylight cover system according to claim 1, wherein said angle-selective radiation controlling windowpane (16) is optimized spectrally for rejection of infrared radiation.

4. An energy saving skylight cover system according to claim 3, wherein said angle-selective radiation controlling windowpane (16) is optimized spectrally both for rejection of infrared radiation and for rejection of ultraviolet radiation.

5. An energy saving skylight cover system according to claim 4, capable also of attenuating visible light.

6. An energy saving skylight cover system, for controlling radiation entering an interior space through a skylight, comprising:

a) a frame (14) positionable over such skylight;

b) a set of radiation scuppers (18,20) mounted inside such skylight; and c) a diffraction grating windowpane (16) capable of deflecting an input radiation beam to impinge on said set of radiation scuppers (18,20).

7. A radiation redirecting energy saving skylight cover system according to claim 6, wherein said radiation scuppers (18,20) are energy reflecting.

8. A radiation redirecting energy saving skylight cover system according to claim 7, wherein said energy reflecting radiation scuppers (18,20) reflect incident light beams back through said diffraction grating windowpane (16).

9. A radiation redirecting energy saving skylight cover system according to claim 6, wherein said diffraction grating windowpane (16) is a composite set of diffraction gratings providing sufficient aggregate deflection to deflect incident light beams to said set of radiation scuppers (18,20).

10. An energy saving skylight cover system, for controlling radiation entering an interior space through a skylight, comprising:

a) a frame (14) positionable over such skylight;

b) a set of energy absorbing radiation scuppers (18,20) mounted inside such skylight; and c) a diffraction grating windowpane (16) capable of deflecting an input radiation beam to impinge on said set of radiation scuppers (18, 20).

11. An energy saving skylight cover system, for modifying the transmission of an incident light beam entering through the skylight, into an interior space, comprising:

a) a frame (14) positionable over such skylight;

b) a partially energy reflecting windowpane (16) mounted in said frame (14) and comprising at least one diffraction grating, capable of transmitting a fraction of an incident radiation beam into such interior space.

12. An energy saving skylight cover system according to claim 11, wherein said diffraction grating is selective for accepting low azimuth angle sunlight and rejecting high azimuth angle sunlight.

13. An energy saving skylight cover system according to claim 11, wherein said energy reflecting windowpane (16) comprises a plurality of layers, in optical series, at least one of said layers being a diffraction grating and at least one of said layers being a chromogenic coating.

14. An energy saving skylight cover system, for controlling radiation entering an interior space through a skylight, comprising:

a) a frame (14) positionable over such skylight;

b) a set of radiation scuppers (18,20) mounted inside the interior space enclosed by said skylight; and c) an angle-selective radiation control windowpane (16) capable of redirecting radiation impinging at an incidence angle greater than a characteristic angle to said set of radiation scuppers (18,20) and admitting into such interior space radiation impinging at an incidence angle less than said characteristic angle.

15. An energy saving skylight cover according to claim 14, wherein said angle-selective windowpane (16) comprises diffraction grating means, the reflectivity of said diffraction grating means being selective with respect to a characteristic angle such that:

a) a substantial portion of the radiation striking said diffraction grating means at incidence angles less than said characteristic angle is transmitted into the interior space;

b) a substantial portion of the radiation striking said diffraction grating means at incidence angles greater than said characteristic angle is reflected; and c) a substantial portion of the radiation incident at angles greater than said characteristic angle and not reflected by said diffraction grating means is directed by said diffraction grating means to said scuppers.

16. An energy saving skylight cover according to claim 15, wherein such characteristic angle is a function of the latitude of the installation.

17. An energy saving skylight cover according to claim 15, wherein such characteristic angle is a composite function of the latitude and the orientation of the skylight.

18. An energy saving skylight cover according to claim 15, wherein said energy reflecting windowpane (16) comprises a plurality of diffraction gratings in optical series.

* * * * *